United States Patent [19]

Sours et al.

[11] 4,423,844

[45] Jan. 3, 1984

[54] APPARATUS FOR SHREDDING MATERIALS

[75] Inventors: William A. Sours; James F. Sullivan, both of Dallas, Tex.

[73] Assignee: Triple/S Dynamics, Inc., Dallas, Tex.

[21] Appl. No.: 308,133

[22] Filed: Oct. 2, 1981

[51] Int. Cl.[3] ..... B02C 25/00

[52] U.S. Cl. ..... 241/35; 241/36; 241/236; 241/285 B

[58] Field of Search ..... 241/230–234, 241/30, 32, 34, 35, 36, 37, 235, 236, 285 R, 285 A, 285 B

[56] References Cited

U.S. PATENT DOCUMENTS

| | | | |
|---|---|---|---|
| 574,273 | 12/1896 | Roger . | |
| 2,905,396 | 9/1956 | Fye | 241/231 X |
| 2,984,423 | 5/1961 | Roth . | |
| 3,881,663 | 5/1975 | Brown | 241/285 R |
| 3,970,256 | 7/1976 | Ruegger et al. | 241/231 |
| 4,168,806 | 9/1979 | Jakobs | 241/232 |
| 4,351,485 | 9/1982 | Hardwick et al. | 241/236 X |

*Primary Examiner*—Mark Rosenbaum

*Attorney, Agent, or Firm*—Richards, Harris & Medlock

[57] ABSTRACT

A material shredder (20) includes a cutting chamber (40) having a pair of counterrotatable cutter units (42, 44) for shredding material fed therebetween. A hopper (30) leads to the cutting chamber for directing material to be shredded thereto. A gate structure (130) includes a barrier plate (138) movable from a first position adjacent one wall of the hopper to a second position at least partially blocking the passageway between the hopper and the cutting chamber. Control structure is provided for exerting a selectable pressure on the barrier plate (138) urging the plate into its second position against any material in its path of movement from its first position to its second position. The plate acts to support the material thereabove, as well as compress the material in its path causing a head of material to be supported above the plate. Subsequent to the movement of the gate structure of its position closing off the movement of material to the cutting chamber, one of the cutter units (42) is moved away from the cooperating cutting unit (44) to permit the passage of the blockage through the cutting chamber. After the blockage has dropped through the cutting chamber, the movable cutter unit (42) is repositioned adjacent to the fixed cutter unit (44) and the barrier plate (138) is withdrawn to its position adjacent the hopper and shredding of material is resumed.

21 Claims, 6 Drawing Figures

APPARATUS FOR SHREDDING MATERIALS

TECHNICAL FIELD

The present invention relates to a method and apparatus for shredding solid waste and for handling unshreddable material encountered during the shredding process.

BACKGROUND ART

Solid waste is often shredded, or otherwise reduced, as a first step in the process of either reclaiming certain material from the waste or for later treatment or disposal. In the past, such shredders have normally incorporated cutting units having counterrotation shafts with intermeshing cutting knives. The waste material to be reduced is passed between the cutting units where it is shredded into smaller pieces. Hammer mills are also used in solid waste reduction. These devices employ a high speed rotating hammer device which impacts the material to be reduced resulting in pulverization of the material.

In both types of prior art devices, material which cannot be reduced is often encountered. Such materials could include steel bars, engine crank shafts or heavy steel cables. When such materials are encountered, the shredding process must be interrupted to permit the unshreddable material to be removed from the cutting chamber. In some cases, this involves entering the cutting chamber either by tool or by hand to remove the blockage. In other systems, this problem has been dealt with by attempting to force the blockage through by increasing power to the cutting units. Other systems provide for inverting the entire cutting chamber to remove the unshreddable material. It can be appreciated that the equipment required in this method of removing the blockage is complex and quite expensive. In other systems, the cutting units must be disassembled to remove the blockage.

In crusher units employing cooperating crushing drums for passage of material therebetween to effect the crushing process, a hydraulically biasing mechanism has been used to apply grinding pressure while permitting movement of one of the grinding rollers away from the cooperating roller to permit the passage of hard substances therebetween. Such a device is disclosed in U.S. Pat. No. 574,273 to J. Roger, issued Dec. 29, 1896. Similarly, U.S. Pat. No. 2,984,423 to E. Roth issued May 16, 1961, discloses a roller mill having a fixed grinding roller and a movable grinding roller for cooperation with a fixed roller for grinding material therebetween. The position of the movable grinding roller relative to the fixed roller may be controlled in response to the amount of material delivered to the grinding chamber.

Although these systems may work satisfactorily for their intended purpose, they are not intended to handle the problem of complete blockage in a grinding unit where such blockage cannot be dislodged by permitting the movement of one grinding or cutting unit relative to the other. In material shredding devices having substantially parallel shafts with cutting knives extending therefrom and intermeshing during rotation to shear or cut the material, adjustment such as that shown in the patent to Roth for varying the pressure between the movable and fixed grinding units would not serve to remove unshreddable waste material confronted during the grinding process.

DISCLOSURE OF THE INVENTION

Thus, a need has arisen for a device and method for handling those situations where unshreddable material is encountered during the reduction of solid waste. In accordance with one embodiment of the invention, a material shredder includes a cutting chamber having a pair of counterrotatable cutter units for shredding material fed therebetween. The cutter units include substantially parallel shafts having cutting knives extending therefrom. The knives are spaced along the shafts so that they intermesh upon rotation, thereby shearing or cutting the material fed therebetween. The cutting units are counterrotated at differing speeds of rotation to facilitate cutting of the material fed therethrough.

A hopper is provided leading to the cutting chamber for directing material to be shredded thereto. A gate structure is operable to prevent the movement of material through the hopper and to the cutting chamber when there is a blockage in the cutting chamber. With the gate structure in its position to block the movement of material to the cutting chamber, one of the pairs of cutter units is pivoted away from the other, thereby opening the cutting chamber to permit passage of the blockage therethrough. Subsequent to the clearing of the cutting chamber, the movable cutter unit is repositioned to its operating position and locked in place. The gate structure is withdrawn from its position blocking the flow of material to the cutting chamber and the reduction process is resumed.

In a preferred embodiment of the invention, the gate structure includes a barrier plate movable from a first position adjacent one wall of the hopper to a second position at least partially blocking the passage between the hopper and the cutting chamber. The barrier plate is movable by hydraulic cylinders mounted between the hopper structure and the barrier plate. Control structure is provided for exerting a selectable pressure on the barrier plate urging the plate into its second position against any material in its path of movement from its first position to its second position. The plate acts to support the material thereabove, as well as compress the material in its path causing the head of material to be supported thereabove. In this way, material is prevented from moving into the cutting chamber.

In accordance with a more specific embodiment of the invention, the gate structure includes a U-shaped gate having substantially parallel side legs joined at one end by a barrier plate. The U-shaped gate is pivoted at points substantially at the end of the side legs remote from the barrier plate such that the barrier plate moves from a first position adjacent one wall of the hopper to a second position within the flow path of material fed from the hopper to the cutting chamber. The gate is pivoted by the action of cylinders attached between the hopper and appropriate points on the gate structure.

Subsequent to the movement of the gate structure to its position closing off the movement of material to the cutting chamber, one of the pairs of cutter units is moved away from the cooperating cutter unit to permit the passage of the blockage through the cutting chamber. In the preferred embodiment, the movable cutter unit includes a pair of support plates pivotally supported relative to the fixed cutter unit and supporting the movable cutter therebetween. The movable cutter unit is moved to the open position by the use of hydraulic cylinders attached between the support plates and the structure supporting the fixed cutter unit. Control structure is provided for selectively extending and retracting the cylinders to pivot the plates supporting the movable cutter unit, thereby moving the movable cutter unit relative to the fixed cutter unit.

The movable cutter unit is normally locked in place by a hydraulic cylinder controllable to actuate a locking pin for fixing the movable cutter unit relative to the fixed cutter unit. The lock assembly includes a slot for receiving an ear attached to the support plates of the movable cutter unit. A locking pin is extendable from the hydraulic cylinder through the aperture in the ear and into an aperture in the lock assembly on the opposite side of the ear. In this way, the movable cutter is fixed relative to the fixed cutter.

The present invention also is directed to the method of operation conducted by the apparatus just described. In the method of operation, the rotation of the cutter units is controlled to sequence through a desired number of rotational reversals when a blockage of the cutter units occurs. Thus, upon sensing a blockage in the cutting chamber, the rotation of the cutters is automatically reversed for a prescribed period and then rotated in a forward direction. This sequence is repeated a predetermined number of cycles. If the blockage is not dislodged in this way, the gate structure is used to prevent the movement of material into the cutting chamber and the movable cutter unit is pivoted away from the fixed cutting unit to permit the blockage to fall out of the cutting chamber. The movable cutting unit is then pivoted into its operating position and locked in place. The gate structure is retracted and the shredding process is resumed.

It will be understood that in some cases, blocking the movement of material through the hopper prior to opening the cutting chamber may not be required. For example, where there is not a buildup of material remaining in the hopper, use of a gate structure may be unnecessary. In this situation, the cutting chamber is merely opened to permit passage of the blockage, as well as the remainder of the material in the hopper to pass therethrough.

BRIEF DESCRIPTION OF DRAWINGS

For a more complete understanding of the present invention, and for further details and advantages thereof, reference is now made to the following description taken in conjunction with the accompanying drawings, in which.

DETAILED DESCRIPTION

Figure 1:
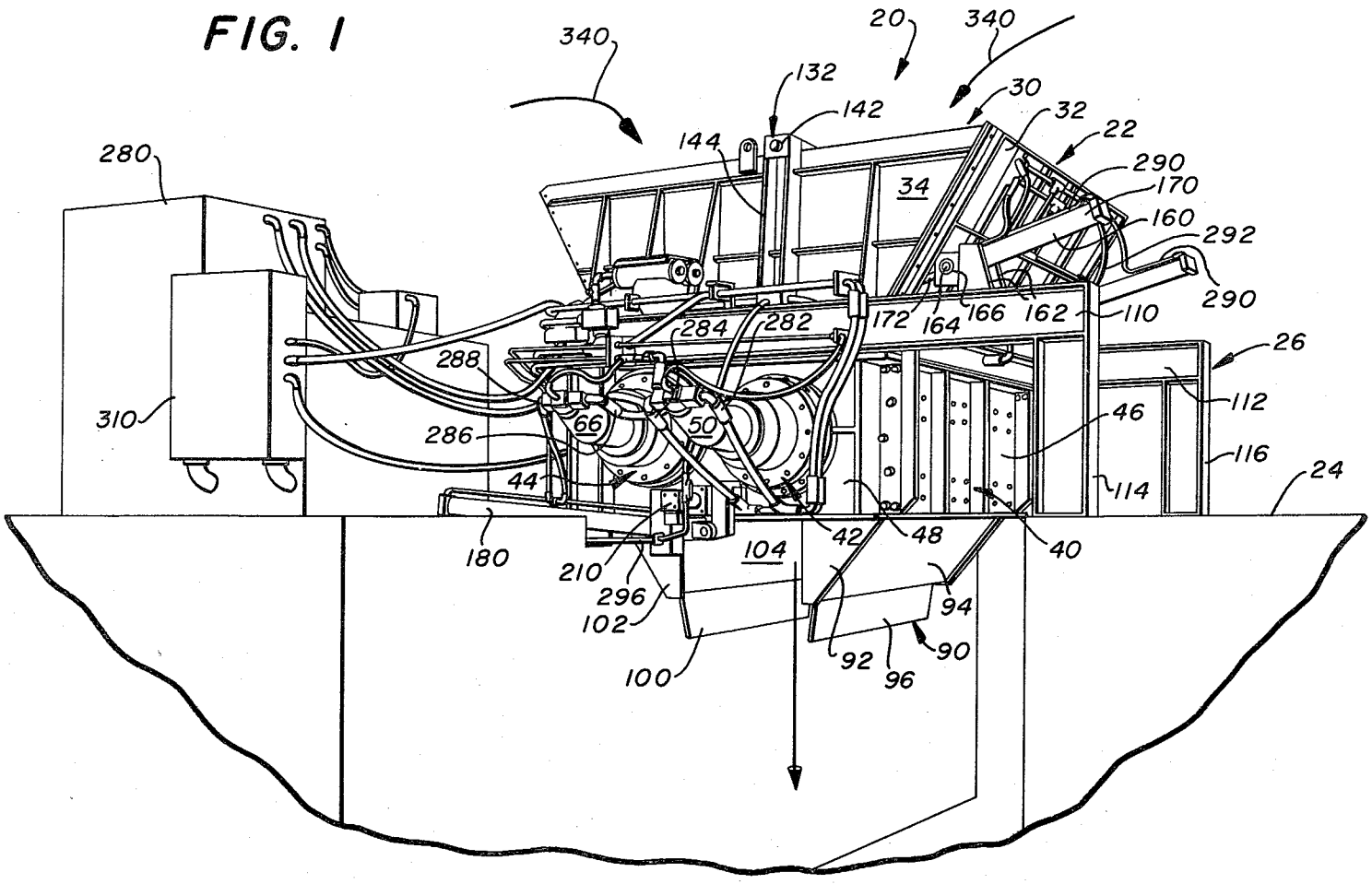
FIG. 1 illustrates a perspective view of the solid waste shredder of the present invention.
Figure 2:
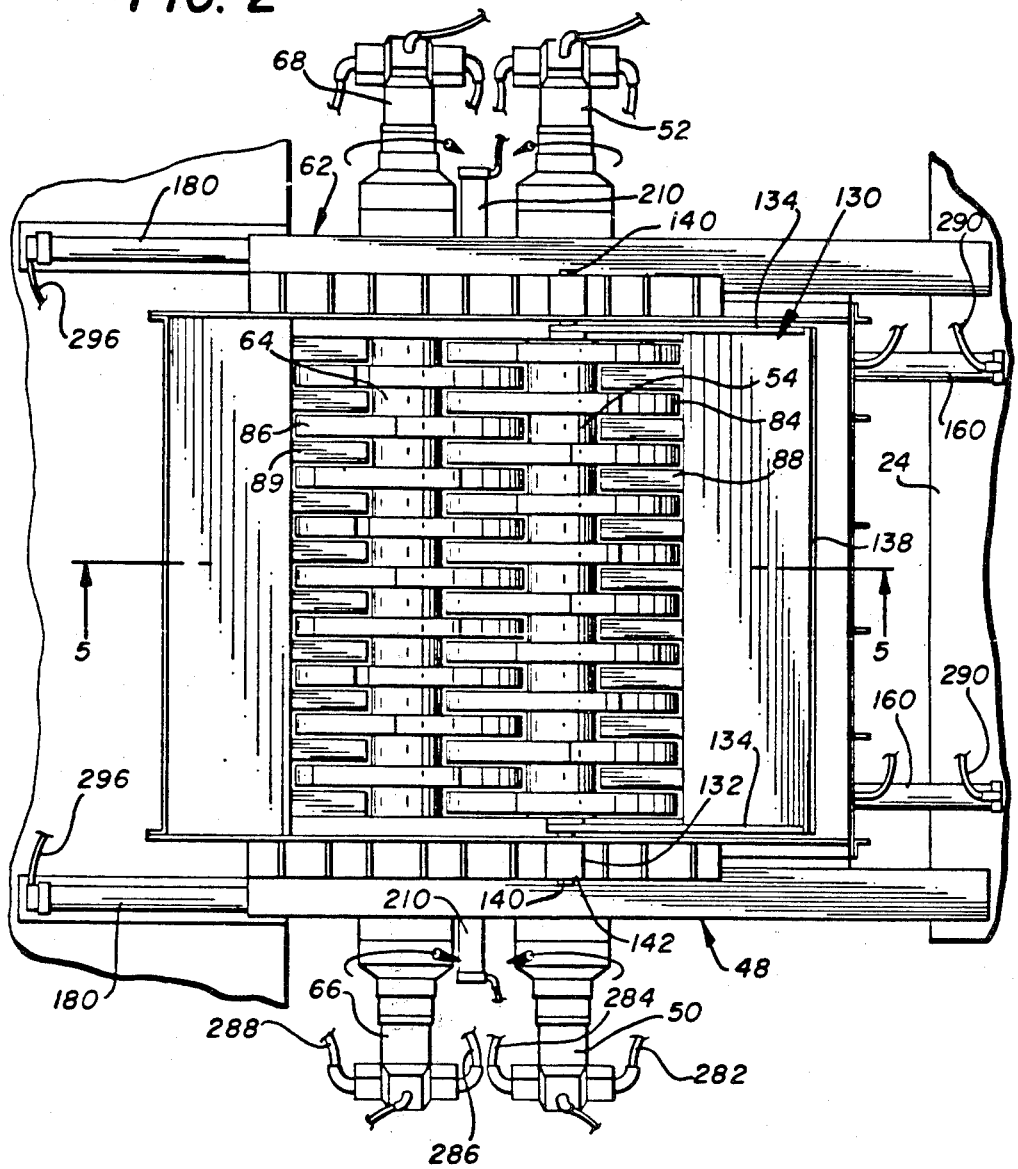
FIG. 2 illustrates a top view of the solid waste shredder.

Referring to FIGS. 1 and 2, the solid waste shredder 20 of the present invention includes a main body unit 22 supported from an elevated ground area 24 by a support structure 26. The main body unit includes a hopper 30 having inclined side walls 32 and end walls 34. Hopper 30 leads to a cutting chamber 40 including a movable cutter unit 42 and a fixed cutter unit 44. As is seen in FIG. 1, movable cutter unit 42 has a side wall 46 and an end plate 48. Cutter unit hydraulic motors 50 and 52 are supported from end plates 48. A cutter unit 54 is supported between end plates 48 of movable cutter unit 42 and is driven by hydraulic motors 50 and 52 as will be described hereinafter in greater detail.

Fixed cutter unit 44 includes a side wall 60 and end plates 62. A cutting rotor 64 is supported between end plates 62 and is driven by hydraulic motors 66 and 68 attached to the end plates by appropriate fittings.

Figure 5:
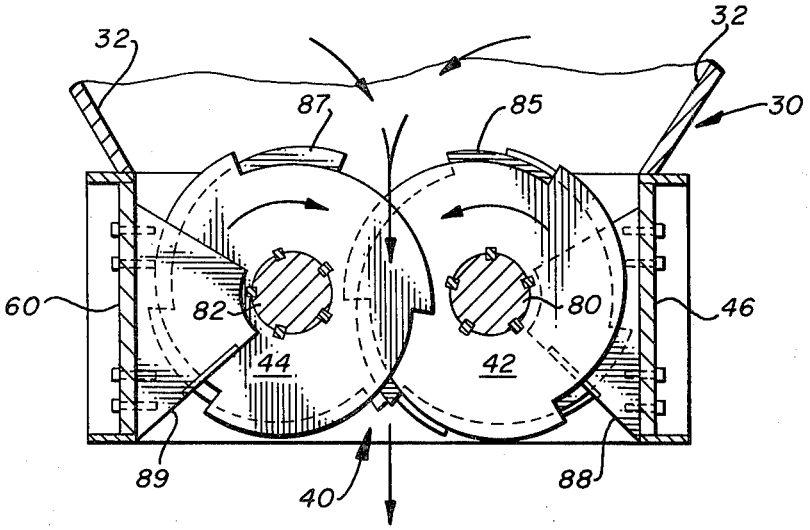
FIG. 5 is a section view taken along line 5—5 of FIG. 2.

Referring to FIG. 2, cutter rotors 54 and 64 include rotor shafts 80 and 82, respectively. These shafts extend through end plates 48 and 62, respectively, for driving engagement with hydraulic motors 50, 52 and 66, 68, respectively. Shaft 80 has a plurality of cutting blades 84 equally spaced therealong. Each blade has three teeth 85 formed thereon. Shaft 82 has similar cutting blades 86 mounted thereon, and spaced along the shaft. Each blade has three teeth 87 formed thereon. Blades 84 and 86 are spaced so that they intermesh one with the other to affect shredding of the material which is engaged between the cutting rotors. The blades are keyed to the shafts as shown in FIG. 5 and are positioned so that the teeth are staggered from one blade to the other. Scraper plates 88 are attached to and extend from wall 48 of cutting chamber 40 in between blades 84. Similarly, scraper plates 89 are attached to and extend from the opposite side wall of cutting chamber 40 in between blades 86. The plates act to strip material from the blades causing it to drop below the cutting chamber, thereby preventing the material from being returned to the hopper area.

Referring again to FIG. 1, a discharge chute 100 extends downwardly from the side wall and end plates of movable cutter unit 54. Chute 90 includes end plates 92, side plate 94 and lower discharge plate 96. Discharge chute 100 extends downwardly from the end plates and side wall of fixed cutter unit 44. Discharge chute 100 includes end plates 102, inclined plate 104 and lower discharge plate 106.

Main body unit 22 is supported by support frame 26. Support frame 26 includes horizontal support beams 110 and 112 which are attached to main body unit 22 by appropriate means such as welding and use of bolted fittings. Horizontal beams 110 and 112 are supported from the ground area 24 by vertical legs 114 and 116.

Figure 3:
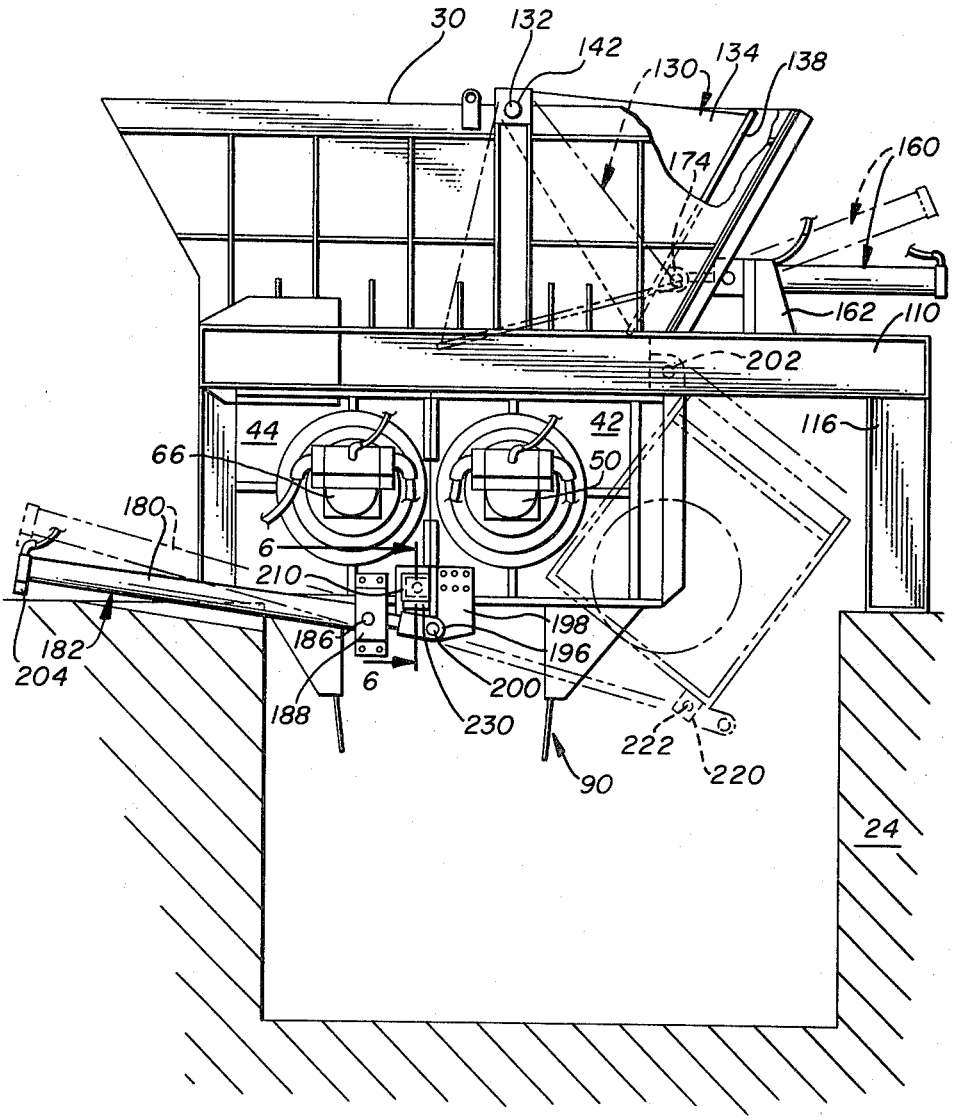
FIG. 3 illustrates a partially broken away side plan view of the solid waste shredder showing the cutting chamber in both the operating and open positions and the gate structure in its operating and closed positions.

Referring to FIGS. 1, 2 and 3, a movable gate structure 130 is pivotally attached to end walls 34 of hopper 30 at a pivot support 132. Gate structure 130 includes a pair of side walls 134 connected by an end plate 138 (FIG. 3) at the end of side walls 134 remote from pivot support 132. The pivotal connection of gate structure 130 to end wall 34 of hopper 30 is by way of a pin 140 attached to and extending from side walls 134 which is received into a bearing sleeve 142 appropriately supported by plates 144 attached to end wall 34 of hopper 30. As is shown in FIG. 3, gate structure 130 is movable between a first position, illustrated in solid lines in FIG. 3, wherein end plate 138 is adjacent and substantially parallel to side wall 32 of hopper 30, and a second position, shown in phantom lines in FIG. 3, wherein the gate structure is rotated downwardly such that end plate 138 is substantially above cutter units 42 and 44.

Movement of gate structure 130 from the first position to the second position is accomplished by actuation of gate cylinders 160. The cylinders are supported from horizontal support beams 110 by a pair of cylinder supports 162. A shaft 164 extending from each cylinder 160 is received within a bearing structure 166 to provide pivotal support of the cylinder from supports 162. Cylinders 160 include a cylinder portion 170 with a piston 172 extending therefrom. The working end of piston 172 is pivotally attached by a clevis fitting 174 to gate structure 130. As can be appreciated by reviewing FIG. 3, the extension of cylinder 160 results in the pivoting of gate structure 130 about pin 140 to the second position illustrated in phantom lines in FIG. 3. Retraction of cylinder 160 withdraws the gate structure 130 to the position shown in solid lines in FIG. 3.

Figure 4:
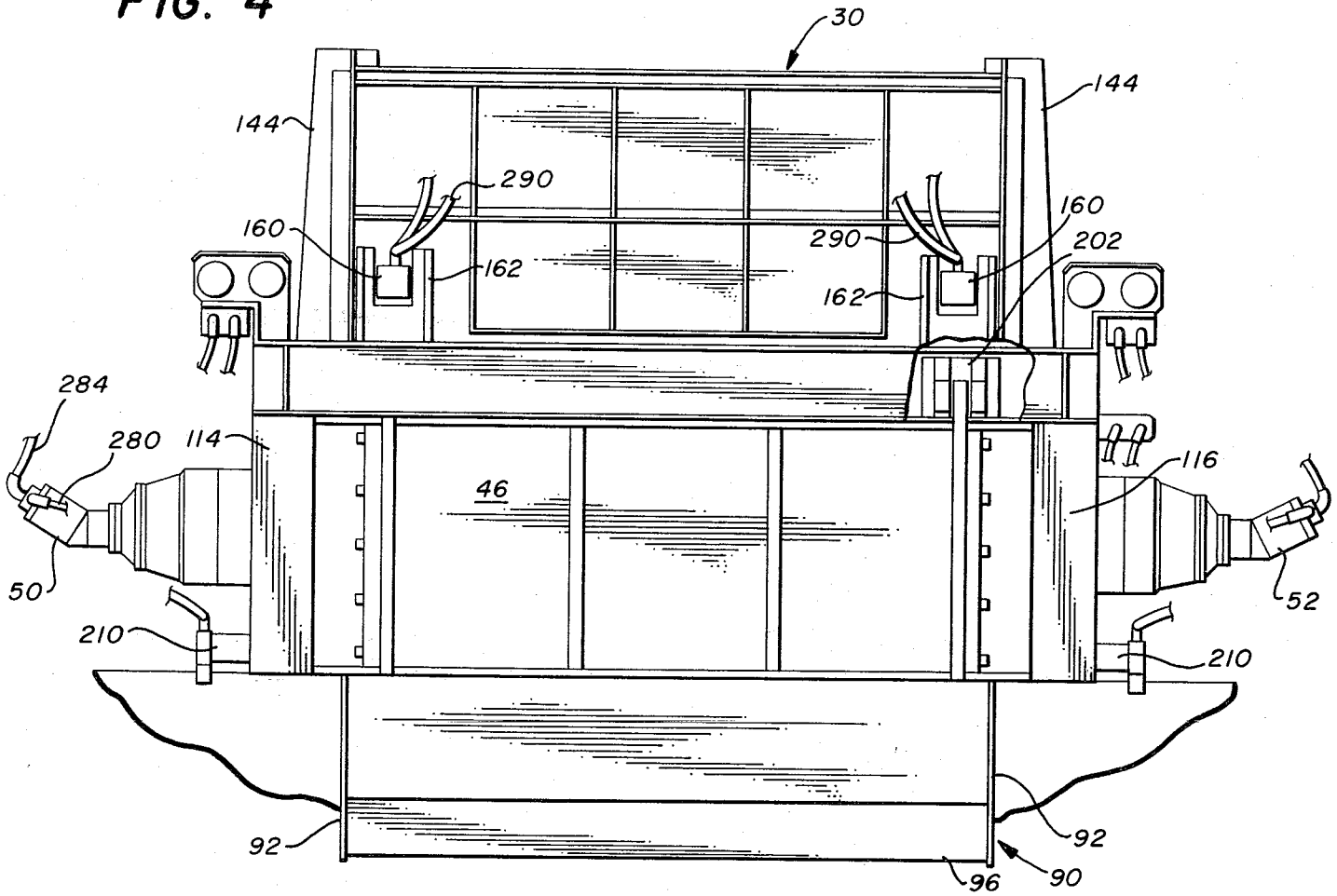
FIG. 4 illustrates a partially broken away side plan view of the solid waste shredder.

Referring specifically to FIGS. 1 and 3, a pair of control cylinders 180 is attached between fixed cutter unit 44 and movable cutter unit 42. Control cylinder 180 includes a cylinder portion 182 having an extendable piston 184 receivable therein. Cylinder portion 182 is pivotally attached to fixed cutter unit 44 by a swivel collar 186 received within a bracket fitting 188 attached by appropriate bolts to fixed cutter unit 44. A clevis 196 is attached to the end of piston 184 and is coupled to a fitting 198 attached to movable cutter unit 42 by pin 200. As is seen in FIG. 4, movable cutter unit 42 is pivoted from the lower end of hopper 30 by suitable hinge structure 202. A position sensor 204 is mounted on the end of piston 184 and provides an indication of the position of extension or retraction of the cylinder as will hereinafter be described in greater detail.

It will be appreciated by those skilled in the art that other types of linear actuators may be substituted for the hydraulic gate cylinders 160 and control cylinders 180. Thus, hydraulic, pneumatic or electromechanical linear actuators may be used as desired.

Figure 6:
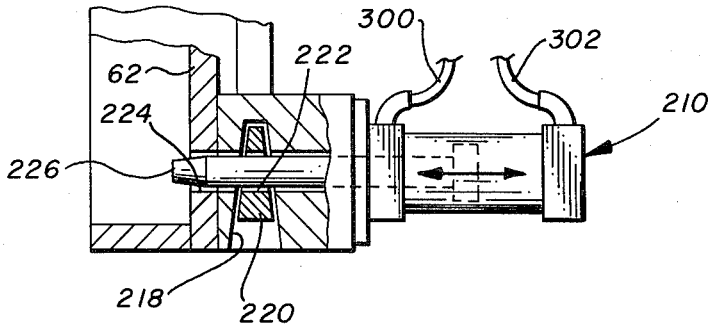
FIG. 6 is a partial section view taken along line 6—6 of FIG. 3.

As is best seen in FIGS. 1, 2 and 6, a lock assembly 210 is mounted on each side wall 60 of fixed cutter unit 44. The lock assembly is mounted relative to end plate 62 of cutter unit 44 to provide a gap 218 therebetween to receive a tapered ear 220 extending from movable cutter unit 42. Ear 220 has an aperture 222 therein which aligns with a bore 224 in the end plate of fixed cutter unit 44 when the movable cutter unit is in its operating position shown in solid lines in FIG. 3. Lock assembly 210 includes an extendable pin 226 which is in line with aperture 222 in fixed cutter unit 44. As can be appreciated, with movable cutter unit 42 in the operating position as shown in solid lines in FIG. 3, ear 220 and aperture 222 are engaged within gap 218 between lock assembly 210 and the end plate of fixed cutter unit 44. Ear 220, and therefore movable cutter unit 42, is locked in place relative to fixed cutter unit 44 by the extension of pin 226 of lock assembly 210 through aperture 222 of ear 220 and into bore 224 of fixed cutter unit 44. A position indicator 230 is mounted to lock assembly 210 to indicate the position of the lock pin as will be hereinafter described in greater detail.

Hydraulic fluid for operation of the system is supplied by power unit 280. In a preferred embodiment of the invention, the power unit includes two 200 horsepower motors for supplying the necessary hydraulic fluid for driving hydraulic motors 66 and 68 of the cutter units 42 and 44. Power unit 280 also supplies the hydraulic fluid necessary to the operation of gate cylinders 160, cutting chamber control cylinders 180 and lock assemblies 210. As is best seen in FIG. 1, hydraulic lines 282 and 284 supply hydraulic fluid to and from hydraulic motor 50. Hydraulic lines 286 and 288 supply hydraulic fluid to and from hydraulic motor 66. Similarly, hydraulic lines 290 and 292 supply hydraulic fluid to and from gate cylinders 160. Hydraulic lines 294 and 296 supply hydraulic fluid to and from cutting chamber control cylinders 180. Hydraulic lines 300 and 302 supply hydraulic fluid to lock assemblies 210.

A controller 310 acts in conjunction with power unit 280 to provide a means of manual or automatic control to the system.

The normal operation of the system in the preferred embodiment is as follows. Waste material is loaded into hopper 30 as is indicated by arrows 340 (FIG. 1). Hydraulic fluid is directed to hydraulic motors 50, 52, 66 and 68 to drive cutting rotors 54 and 64 in a counter-rotating manner. Cutting rotors 54 and 64 are rotated at differing speeds to facilitate the process. In the preferred embodiment, one rotor is driven at approximately 25 rpm while the other is driven at approximately 40 rpm. Material loaded into hopper 30 is channeled to the cutter units and the material is fed therebetween and shredded by the action of the cutter teeth. Shredded material is received in the loading area below the unit by appropriate trucks or other vehicles.

In the event of a blockage in the shredding process, as for example where an unshreddable piece of material is engaged by the cutting blades, the controller stops the rotation of the rotors by control of hydraulic fluid to the hydraulic motors 50, 52, 66 and 68. This control may be manual or a sensor may be used to sense hydraulic fluid pressure to indicate a blockage in the cutting chamber. The flow of hydraulic fluid to these motors is then reversed to reverse the direction of rotation of the cutter units and thereafter the flow of hydraulic fluid is reversed again to rotate the rotors in their normal cutting mode. This reversal sequence is repeated in accordance with a predetermined format either manually or automatic by a time sequencer.

Where the unshreddable material is again encountered after a preselected number of cutter reversals, hydraulic fluid to the cutter units is arrested. Gate cylinders 160 are extended by directing hydraulic fluid thereto, thereby moving gate structure 130 from the first position shown in solid lines in FIG. 3 to the position shown in phantom in FIG. 3. While there will be material within hopper 30, the design of the gate structure permits the movement of the gate through such material. Where the gate's movement is blocked by the material in the hopper area, a sufficient pressure is applied by cylinders 160 to pinch off the material, thereby forming a barrier to support the head of waste material thereabove.

It will be appreciated that a head pressure on the order of 100 tons may exist over the material in hopper 30. The present apparatus is capable of applying a force of up to about 3200 pounds, thereby providing sufficient force to either move through the material or apply a compressing force to support the head pressure which may exist thereabove.

With the gate structure 130 in place, and upon the receipt of a signal to the controller of its proper positioning, a signal from the controller activates hydraulic fluid to lock assembly 210 withdrawing the lock pin 226 from engagement with ear 220 of movable cutter unit 42. Lock position indicator 230 indicates the withdrawal of lock pin 226, and such signal is received by the controller. Thereafter, hydraulic fluid is supplied to cutting chamber control cylinders 180 to extend the cylinders, thereby rotating movable cutter unit 42 from the position shown in solid lines to that shown in phantom in FIG. 3. As can be appreciated, the opening of the cutting chamber permits the discharge of the unshreddable material therethrough to the area below.

Thereafter, cutting chamber control cylinders 180 are retracted and lock assembly 210 actuated to lock the movable cutter unit in place. Gate cylinders 160 are retracted to withdraw gate structure 130 from the blocking position over the cutting chamber to the position adjacent the side wall of hopper 30. Position sensor 204 and lock position indicator 230 must indicate that cutter unit 42 is closed and locked before gate structure 130 will be withdrawn.

Thereafter, operation of the system is resumed with the continuous feeding of waste material into the unit and the rotation of the rotor cutters to shred the material therethrough.

Where there is little or no additional material in hopper 30 when a blockage is encountered, movement of the gate across the hopper area may be unnecessary. The operator may choose to manually actuate the control for pivoting movable cutter unit 42 to the open position shown in phantom in FIG. 3. With the gate structure in its retracted position as shown in solid lines in FIG. 3, both the blockage, as well as the remainder of material in the hopper, will move through the cutting chamber.

The sequence described above may be controlled automatically and by use of a programmable microprocessor, variations in the sequence can also be readily made as needed. Similarly, manual control of the unit provided with automatic controls to prevent the opening of the chamber without the gate structure in place to prevent movement of materials through the cutting chamber is also considered within the scope of the present invention.

Therefore, the present invention provides a device and method for handling those situations where unshreddable material is encountered during the reduction of solid waste. The system provides for such situations without risk of damage to the apparatus and with a minimum of additional machinery or controls.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A material shredder comprising:

a cutting chamber having a moveable cutter unit and a fixed cutter unit therein for shredding material fed into the cutting chamber;

means for moving said moveable cutter unit away from said fixed cutter unit when a blockage occurs in said cutting chamber to permit passage of the blockage through the cutting chamber; and releasable lock means for selectively locking said moveable cutter unit to said fixed cutter unit when in the operating position.

2. The shredder according to claim 1 further comprising:

a hopper for directing material to be shredded to the cutting chamber; and gate means positionable above said cutting chamber prior to movement of said moveable cutter unit away from said fixed cutter unit for preventing movement of material from said hopper to the cutting chamber.

3. The shredder according to claim 2 wherein said gate means includes:

a barrier plate movable between a first position adjacent one wall of the hopper and a second position at least partially blocking the passage between the hopper and cutting chamber; and means for exerting a desired pressure on said barrier plate urging said plate into the second position and against material in its path of movement from its first to its second position to block the material thereabove from moving past said barrier plate.

4. The shredder according to claim 3 further comprising:

linear actuator means attached between said hopper and said gate means; and means for extending or retracting said actuator means to move said gate means between the first and second positions.

5. The shredder according to claim 3 further comprising:

means for moving said gate means to the second position in response to a blockage in the cutting chamber.

6. The shredder according to claim 5 further comprising:

control means for sequentially moving said moveable cutter unit away from said fixed cutter unit subsequent to the movement of said gate means to its second position.

7. The shredder according to claim 2 wherein said gate means includes:

a U-shaped member having a pair of substantially parallel side legs joined at one end by a barrier plate; and means for pivoting said U-shaped member about points on said side legs remote from said barrier plate such that said barrier plate may be moved from a first position adjacent the wall of said hopper to a second position within the material flow path from the hopper to the cutting chamber.

8. The shredder according to claim 7 wherein said pivoting means includes:

linear actuator means attached between said hopper and said gate means; and control means for extending or retracting said linear actuator means to move said gate means between the first and second positions.

9. The shredder according to claim 1 wherein said moveable cutter unit includes a pair of support plates pivotally supported relative to said fixed cutter unit;

wherein said means for moving said moveable cutter unit includes linear actuator means attached between said support plates and said fixed cutter unit; and control means for selectively controlling the extension and retraction of said linear actuator means to pivot said plates thereby moving said moveable cutter unit away from said fixed cutter unit.

10. The shredder according to claim 9 wherein said lock means includes:

an ear extending from said support plates and having an aperture therethrough; and a lock receiving assembly including a slot for receiving said ear therein when said moveable cutter unit is in the operating position and a linear actuator for selectively extending a locking pin through the aperture in said ear and into an aperture in said lock receiving assembly thereby fixing said moveable cutter unit relative to said fixed cutter unit.

11. A material shredder comprising:

a cutting chamber having a moveable cutter unit and a fixed cutter unit therein for shredding material fed into the cutting chamber;

means for moving said moveable cutter unit away from said fixed cutter unit when a blockage occurs in said cutting chamber to permit passage of the blockage through the cutting chamber;

said moveable cutter unit including a pair of support plates pivotally supported relative to said fixed cutter unit;

said means for moving said moveable cutter unit including linear actuator means attached between said support plates and said fixed cutter unit;

control means for selectively controlling the extension and retraction of said linear actuator means to pivot said plates thereby moving said moveable cutter unit away from said fixed cutter unit; and releasable lock means for selectively locking said moveable cutter unit to said fixed cutter unit when in the operating position.

12. A material shredder comprising:

a cutter chamber having a first cutting unit cooperating with an adjacent second cutting unit for shredding material fed therebetween;

means for directing material to the cutting chamber;

gate means actuable in response to a blockage in said cutting chamber for preventing movement of material to the cutting chamber;

means operable in sequence with said gate means for moving said first cutting unit away from said adjacent second cutting unit to permit passage of the blockage through the cutting chamber; and releasable lock means for selectively locking said first cutting unit to said adjacent second cutting unit when in the operating position.

13. The shredder according to claim 12 wherein said gate means includes:

a barrier plate movable between a first non-blocking position and a second position at least partially blocking the passage of material to the cutting chamber; and means for exerting a desired pressure on said barrier plate urging said plate into the second position and against material in its path of movement from its first to its second position to block the material thereabove from moving past said barrier plate.

14. The shredder according to claim 13 further comprising:

linear actuator means attached to said gate means; and means for extending or retracting said linear actuators to move said gate means between the first and second positions.

15. The shredder according to claim 13 further comprising:

means for moving said gate means to the second position in response to a blockage in the cutting chamber.

16. The shredder according to claim 15 further comprising:

control means for sequentially moving said first cutting unit away from said adjacent second cutting unit subsequent to the movement of said gate means to its second position.

17. The shredder according to claim 12 wherein said gate means includes:

a U-shaped member having a pair of substantially parallel side legs joined at one end by a barrier plate; and means for pivoting said U-shaped member about points on said side legs remote from said barrier plate such that said barrier plate may be moved from a first position to a second position with the material flow path to the cutting chamber.

18. The shredder according to claim 17 wherein said pivoting means includes:

linear actuator means attached to said gate means; and control means for extending or retracting said linear actuator means to move said gate means between the first and second positions.

19. The shredder according to claim 12 wherein said first cutting unit includes a pair of support plates pivotally supported relative to said adjacent second cutting unit;

wherein said means for moving said first cutting unit includes linear actuator means attached between said support plates and said adjacent second cutting unit; and control means for selectively controlling the extension and retraction of said linear actuator means to pivot said plates thereby moving said first cutting unit away from said adjacent second cutting unit.

20. The shredder according to claim 19 wherein said lock means includes:

an ear extending from said support plates and having an aperture therethrough; and a lock receiving assembly including a slot for receiving said ear therein when said first cutting unit is in the operating position and a linear actuator for selectively extending a locking pin through the aperture in said ear and into an aperture in said lock receiving assembly thereby fixing said first cutting unit relative to said adjacent second cutting unit.

21. A material shredder comprising:

a cutting chamber having a first cutting unit cooperating with an adjacent second cutting unit for shredding material fed therebetween;

means for directing material to the cutting chamber;

gate means actuable in response to a blockage in said cutting chamber for preventing movement of material to the cutting chamber;

means operable in sequence with said gate means for moving said first cutting unit away from said adjacent second cutting unit to permit passage of the blockage through the cutting chamber;

said gate means including a U-shaped member having a pair of substantially parallel side legs joined at one end by a barrier plate;

said gate means further including means for pivoting said U-shaped member about points on said side legs remote from said barrier plate such that said barrier plate may be moved from a first position to a second position with the material flow path to the cutting chamber;

said pivoting means including linear actuator means attached to said gate means;

said pivoting means further including control means for extending or retracting said linear actuator means to move said gate means between the first and second positions; and releasable lock means for selectively locking said first cutting unit to said adjacent second cutting unit when in the operating position.

* * * * *